US006006446A

United States Patent [19]

Pagendarm

[11] Patent Number: 6,006,446

[45] Date of Patent: Dec. 28, 1999

[54] APPARATUS FOR THE TREATMENT, IN PARTICULAR DRYING, OF MATERIAL WEBS

[75] Inventor: Ralph Pagendarm, Halstenbek, Germany

[73] Assignee: Pagendarm Technologie GmbH, Halstenbek, Germany

[21] Appl. No.: 09/064,927

[22] Filed: Apr. 22, 1998

[30] Foreign Application Priority Data

Apr. 24, 1997 [DE] Germany ..... 197 17 187

[51] Int. Cl.[6] ..... F26B 9/00

[52] U.S. Cl. ..... 34/633; 34/634; 34/635; 34/636; 34/638; 34/643

[58] Field of Search ..... 34/621, 623, 629, 34/633, 634, 635, 636, 638, 643, 653, 656; 26/106, 167; 226/95, 97, 196.1

[56] References Cited

U.S. PATENT DOCUMENTS

| | | | |
|---|---|---|---|
| 3,012,335 | 12/1961 | Allander et al. | 34/155 |
| 3,324,570 | 6/1967 | Flaith et al. | 34/156 |
| 3,800,438 | 4/1974 | Meier-Windhorst | 34/643 |
| 3,823,488 | 7/1974 | Houben et al. | 34/643 |
| 4,170,075 | 10/1979 | Scott | 34/160 |
| 4,295,284 | 10/1981 | Witkin | 34/155 |
| 4,341,024 | 7/1982 | Witkin | 226/97 X |
| 4,833,794 | 5/1989 | Stibbe et al. | 34/643 |
| 5,005,272 | 4/1991 | Severinsen | 26/106 |
| 5,191,725 | 3/1993 | Wohlgenannt et al. | 34/635 |
| 5,229,364 | 7/1993 | Heikkila et al. | 34/643 X |

FOREIGN PATENT DOCUMENTS

| | | |
|---|---|---|
| 661122 | 7/1965 | Belgium . |
| 0162946B1 | 10/1989 | European Pat. Off. . |
| 0532486A1 | 3/1993 | European Pat. Off. . |
| 729252 | 7/1932 | France . |
| 970045C | 9/1949 | Germany . |
| 1542417B2 | 4/1970 | Germany . |
| 280762 | 4/1970 | Germany . |
| 3517541 | 11/1986 | Germany . |
| 3715533A1 | 12/1988 | Germany . |
| 4009313A1 | 9/1991 | Germany . |

OTHER PUBLICATIONS

Prospekt: Trocknungsanlagen der Fa. Erler & Co., Hamburg, 1968, H. 7.

*Primary Examiner*—Henry Bennett
*Assistant Examiner*—Steve Gravini
*Attorney, Agent, or Firm*—Abelman, Frayne & Schwab

[57] ABSTRACT

To provide uniform treatment criteria over the entire surface of a material web (10) in the region of a drying chamber (11), the treatment air or intake air is directed onto the material web (10) from above and below by means of slot nozzles (19, 24) from nozzle boxes (17, 18). The return air reflected from the material web (10) is conducted away upwards and downwards via return-flow ducts (25, 26) in the nozzle boxes (17, 18) into a collection space (34), on the one hand, and a return-air space (35), on the other hand.). The return air is conveyed upwards from the lower return-air space (35) through return-flow shafts (36, 37) into the region of the upper collection space (34).

12 Claims, 5 Drawing Sheets

APPARATUS FOR THE TREATMENT, IN PARTICULAR DRYING, OF MATERIAL WEBS

The invention relates to an apparatus for treating thin material webs, in particular of paper, film or the like, with a gaseous medium, in particular air, in drying chamber, through which the material web is conveyed, preferably continuously, and in which the air—intake air—is directed onto the material web from above and from below by means of nozzles, the nozzles being connected to nozzle boxes into which the intake air can be fed.

For this type of dryer it is important that the treatment medium, that is to say in particular intake air, becomes effective with the best possible distribution over the entire treatment surface of the material web. In this case, the material web should be exposed to the same flow conditions and properties of the air, namely in respect of moisture, temperature, etc., over the full width in the region of the drying chamber. Furthermore, cross-currents of air in the region of the material web can cause the edge regions of (very thin) material to flutter, which may adversely affect the drying process.

Consequently, the invention is based on the object of proposing an apparatus which, with a high performance capability, that is to say with high heat transmission values to the material web, enables precise (drying) treatment with constant parameters over the entire treatment surface.

To achieve this object, the apparatus according to the invention is characterized by the following features:

a) arranged above and below the material web in each case is at least one nozzle box with nozzles directed onto the material web, b) the air flowing back from the material web—return air—can be conveyed away by means of return-flow ducts which are arranged in the nozzle boxes and pass through the latter, c) the return-flow ducts open above the upper nozzle boxes into collection space and below the lower nozzle boxes into a return-air space, d) the return air can be conveyed away upwards at least out of the lower return-air space formed below the lower nozzle box by at least one (closed) air conduit, in particular by return-flow shafts which preferably open into the upper collection space.

The invention is based on the finding that optimum treatment results can be achieved if the air flowing back or reflected from the material web, that is to say the return air, is conveyed away directly in the return-flow region, namely by the return-flow ducts arranged in the nozzle boxes. According to the invention, the return air is conducted away in closed conduits, namely return-flow shafts, from the lower collection space in an upward direction to the upper collection space where it is combined with the return air present there. By conducting air in a direct and separate manner from the upper side of the material web on one hand, and from the lower side of the material web on the other, it is possible to avoid a cross-current of air in the region of the material web. In addition, any fluttering at the edge regions of very thin material webs can be avoided. The intake air as well as the return air are led through controlled, closed ducts.

According to a further proposal of the invention, the total volume of return air is partly conducted away to the outside, that is to say out of the treatment space or drying chamber. Part of the return air is mixed with the intake air fed in from outside and, after treatment, is again conducted back into the treatment circuit for the material web.

According to a further proposal of the invention, the intake air is also fed to the nozzle boxes via ducts or conduits. The upper nozzle box is preferably assigned a plurality of intake-air ducts which open into the (upper) nozzle box in areas which are favorable in terms of flow. Intake-air ducts are likewise provided for the lower nozzle box, which ducts are conducted laterally past the upper nozzle box and preferably open into the lower nozzle box at the four corners.

Furthermore, the invention concerns the design of the nozzle boxes. They have continuous slot nozzles which extend transversely to the conveying direction of the material web. Return-flow ducts for the return air are arranged between the slot nozzles, in each case positioned in rows, in the nozzle boxes.

Further details of the invention are explained in greater detail below with reference to exemplary embodiments illustrated in the drawings, in which.

Figure 1:
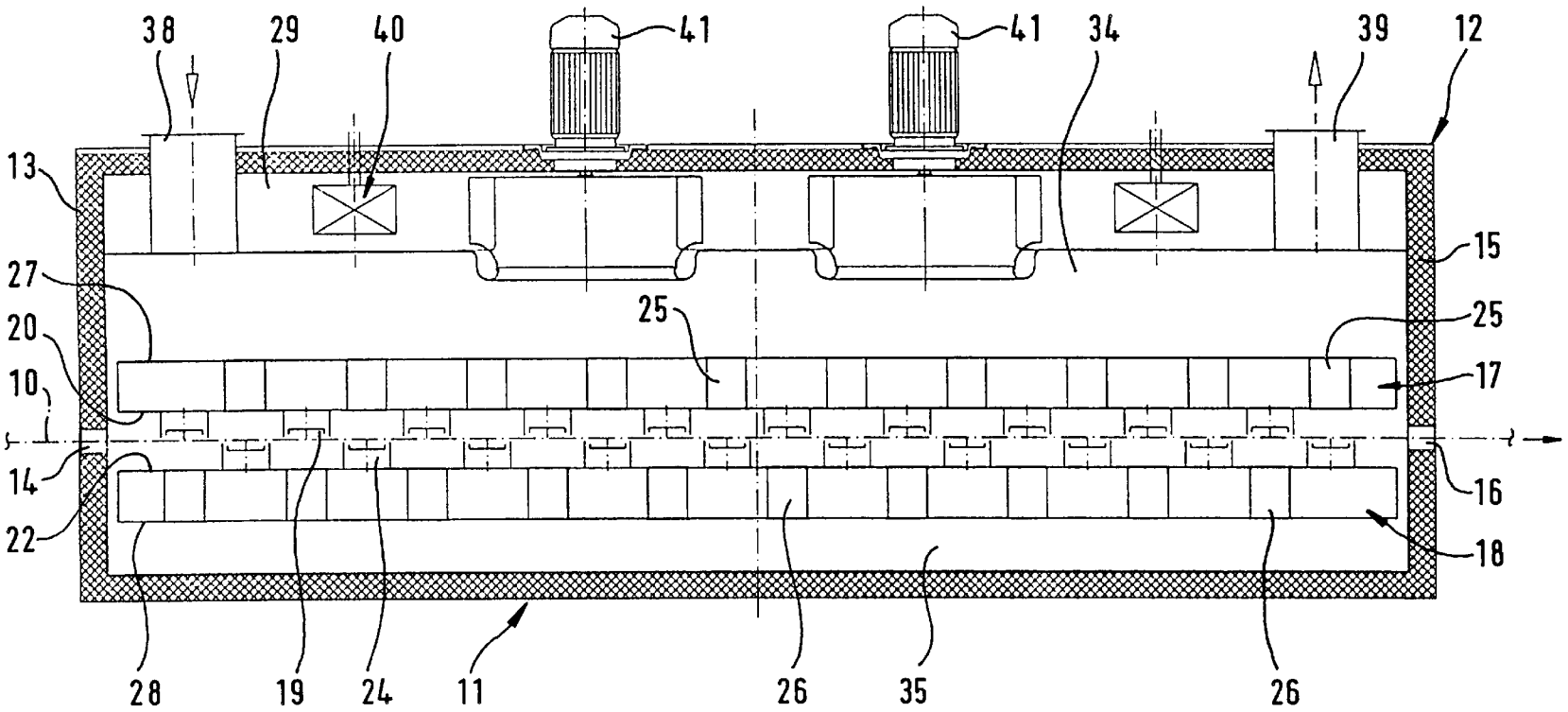
FIG. 1 shows a schematic, longitudinal section of a treatment or drying chamber.
Figure 2:
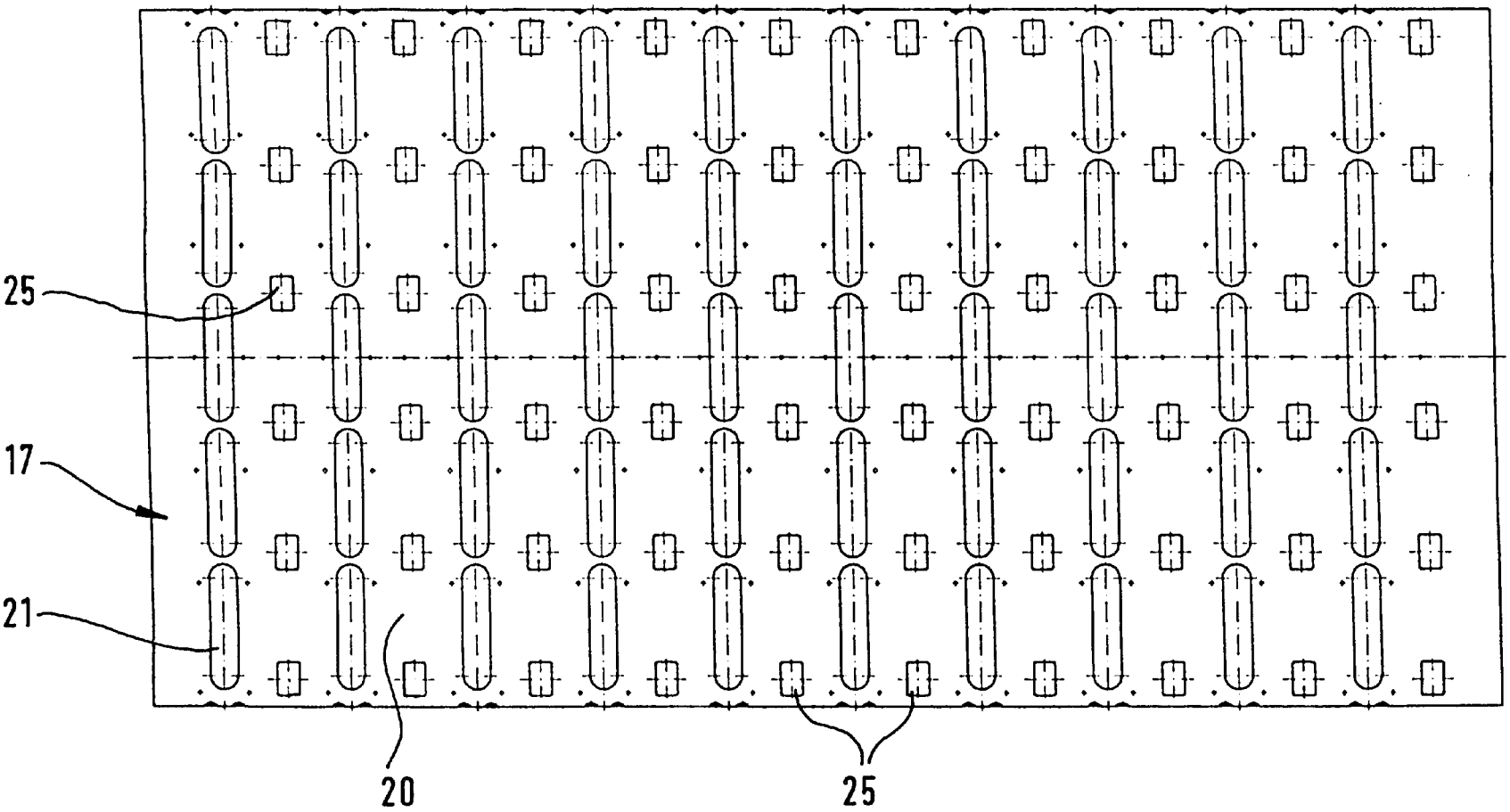
FIG. 2 shows a bottom view of an (upper) nozzle chamber.

The apparatus for treating thin material webs 10 comprises at least one treatment chamber or drying chamber 11. This is a large-volume space which is surrounded on all sides by a chamber housing 12 and in which the treatment, namely in particular drying, of the material web 10 takes place.

The material web 10 is preferably conducted continuously through the drying chamber 11. In the region of an upright front wall 13, the material web enters the drying chamber 11 via an entry slot 14. On the opposite side, the material web 10 exits from the drying chamber 11 in the region of an end wall opposite the front wall 13 in the region of an outlet slot 16.

In the drying chamber 11, the material web 10 is treated with a flowing medium, in particular with (heated) air, namely intake air. The said intake air is directed onto both sides of the material web 10, that is to say from above and from below, by means of nozzles.

For this purpose, a nozzle unit is arranged in each case above and below the material web 10. Said nozzle unit comprises an upper nozzle box 17 and a lower nozzle box 18. The treatment medium, namely intake air, is conducted into the nozzle boxes 17 and 18. Inside the nozzle boxes 17, 18 there is an overpresssure, so that the air flows out of the nozzle boxes 17, 18 downwards and upwards via nozzles and is thus directed as a jet of air against the material web 10.

A large number of nozzles, namely slot nozzles 19 extending transversely to the conveying direction of the material web 10, are arranged on the underside of the upper nozzle box 17. Each of these slot nozzles 19 extends over the full width of the material web 10 or the nozzle box 17. In the conveying direction, the slot nozzles 19 are arranged slightly spaced from one another, for example with a center-to-center spacing of 70 mm to 80 mm. In the longitudinal direction of the slot nozzles 19, these may be configured as integral nozzles which extend over the full width of the material web 10 or the nozzle box 17. They may, however, also be individual nozzle sections adjoining one another.

The slot nozzles 19 are connected to the interior of the nozzle box 17 via openings in a bottom box wall 20. In this case, the openings are oval slots 21 which are arranged in parallel rows slightly spaced from one another in the longitudinal direction of the slot nozzles 19. The slot nozzles 19 adjoin the said slots 21 or a row of such slots 21, so that they are supplied with intake air via the slots 21.

The lower nozzle box 18 is configured similarly. Parallel rows of openings, namely oval slots 23, are likewise arranged in a top box wall 22 facing the material web 10. Adjoining the said slots are slot nozzles 24 of the lower nozzle box 18 in such a way that the said lower slot nozzles 24 are directed upwards and direct a jet of air against the underside of the material web 10.

In relation to the slot nozzles 24 of the lower nozzle box 18, the slot nozzles 19 of the upper nozzle box are offset relative to one another in the direction of movement of the material web. The slot nozzles 19, on the one hand, and 24, on the other hand, are correspondingly positioned "in the gap" relative to one another. This results in optimum guidance and support of the material web 10.

The air flowing back in the region of the material web 10 or reflected by the latter, that is to say return air, is conducted away directly in the region of origin. For this purpose, return-flow ducts 25, 26 are arranged in each nozzle box 17, 18. Said ducts are tubes or pieces of tubes which pass through the nozzle box 17, 18 from the side facing the material web 10 to a collection region for return air formed above and below the nozzle boxes 17, 18. The return-flow ducts 25, 26 or the pieces of tube forming the latter are inserted into the nozzle boxes 17, 18 and are each connected to the bottom box wall 20 and a top box wall 27 or to the box wall 22 and a bottom box wall 28. In the present preferred exemplary embodiment, the return-flow ducts 25, 26 are configured with a polygonal or rectangular cross-section.

The return-flow ducts 25, 26 are distributed over the entire nozzle box 17, 18, specifically in this case in a regular distribution. A row of return-flow ducts 25, 26 is arranged in each case in the spaces between the slot nozzles 19 and 24. The return-flow ducts 25, 26 are arranged in rows aligned in the longitudinal and transverse direction. The cross-sections are chosen such that the generated return air can be conducted away is reliably via the return-flow ducts 25, 26.

Figure 3:
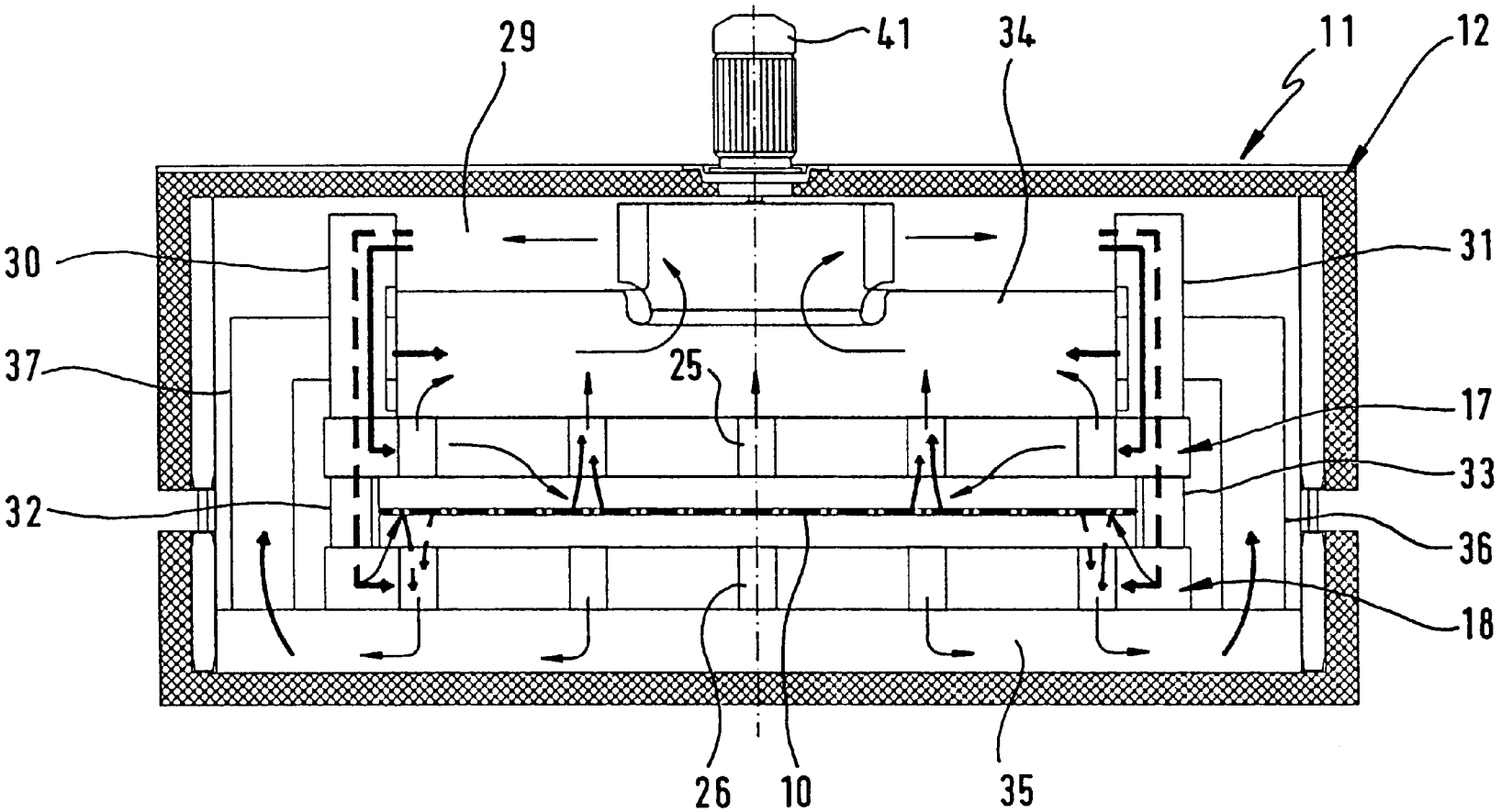
FIG. 3 shows a schematic cross-section of a treatment or drying chamber.
Figure 4:
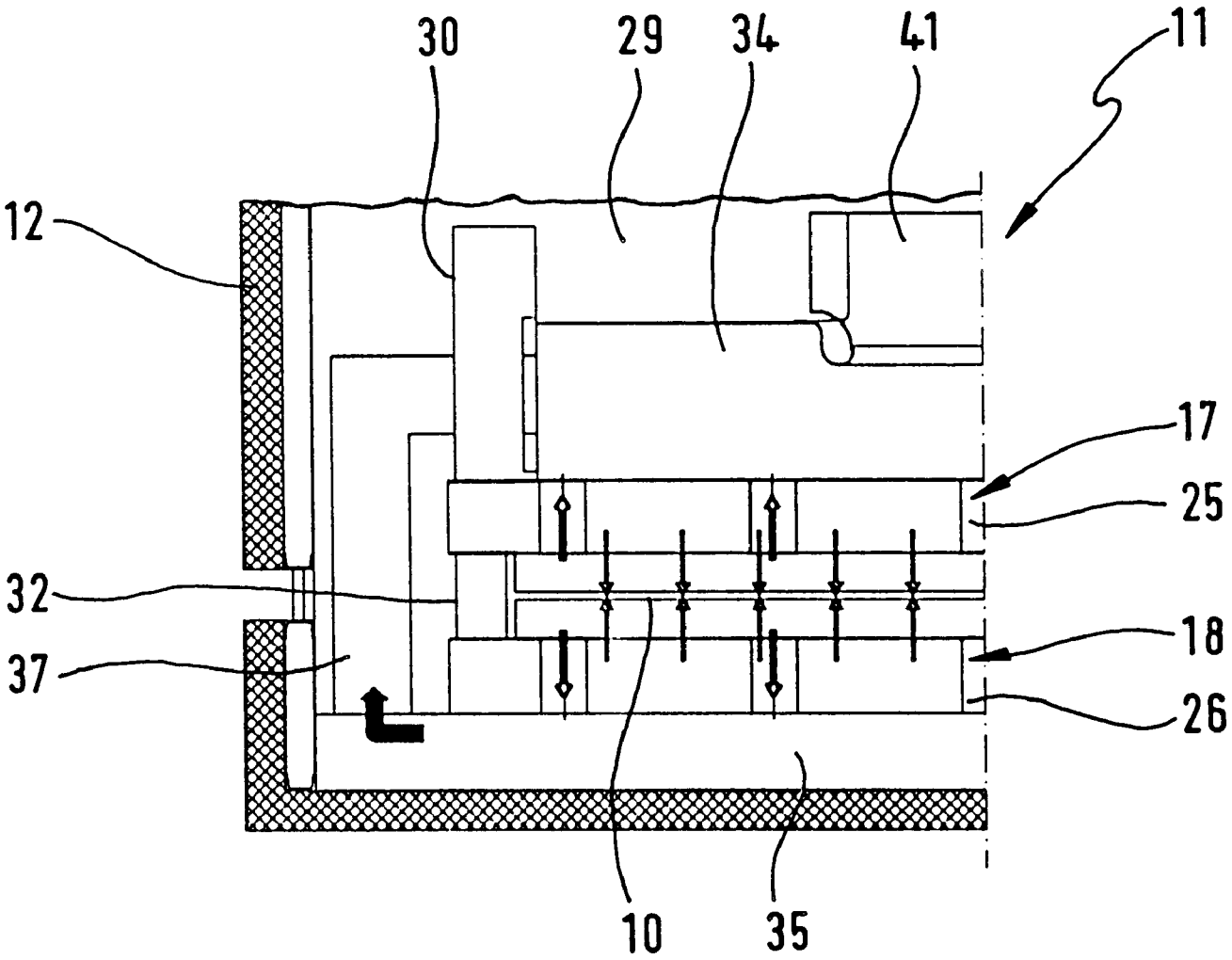
FIG. 4 shows an enlarged view of part of the drying chamber cut away transverse to the conveying direction.

A special feature of the apparatus consists in the separate transport of the treatment or intake air on the one hand and the return air on the other hand, cf. FIG. 3. The intake air is introduced on one hand from a flow duct 29 into the upper nozzle box 17 via closed intake-air ducts 30, 31. In the process, the intake-air 30, 31 are connected to the opposing end regions of a flow duct 29, and directed downwards. The intake-air ducts 30, 31 enter the upper nozzle box 17 from above, specifically in the region of a top box wall 27. Inside the upper nozzle box 17, the intake air builds up an overpressure.

Furthermore, intake air is also fed to the lower nozzle box 18, namely likewise via closed ducts. These are intake-air ducts 32, 33 which are arranged offset relative to the intake-air ducts 30, 31. The intake-air ducts 32, 32 for the lower nozzle box 18 are likewise connected to the flow duct 29 and led laterally past the upper nozzle box 17. Overpressure of intake air also builds up in the lower nozzle box 18.

The return flow of air reflected from the material web, that is to say the return air, is of particular significance. It is important to separate it strictly from the treatment or intake air in the region of the nozzle boxes 17, 18 or the material web 10.

In the region of the upper nozzle box 17, the return air flows via the return-flow ducts 25 directly into the collection space 34 formed above the nozzle box 17. The return air arising in the region of the lower nozzle box 18 is conveyed downwards via the return-flow ducts 26 into a return-air space 35 below the lower nozzle box 18. From this return-air space, the return air is conveyed away in a targeted manner, specifically via return-flow shafts 36, 37. These are open towards the lower return-air space 43. The return air is conveyed upwards through the return-flow shafts 36, 37 laterally next to the lower nozzle box 18 and next to the upper nozzle box 17 (arrow 44) . At that point, the return-flow shafts open into the collection space 34.

From the collection space 34, the return air is again conveyed to the intake-air ducts 30, 31, 32, 33. The intake air is thus conveyed in two closed circuits which are connected via the collection space 34. An air exchange with fresh air can thereby take place, as fresh air is introduced in the region of the flow duct 29 (or of the collection space 34) via a duct 38 and (the same amount of) return air is removed via a return air shaft 39.

Air can be heated by being led over air heaters 40 which are arranged in the collection space 34 or in the flow duct 29. Alternatively, the air heaters can also be arranged in the intake-air ducts 30, 31, 32, 33.

The circulation of air arises due to pressure gradients in the intake air ducts 30, 31, 32, 33 and in the collection space 34. The pressure gradient is generated by fans 41, whose region of suction is connected to the collection space 34 in the flow duct 29, where an overpressure is thereby generated. The fans 41 convey the gaseous medium out of the collection space 34 into the flow canal, where they generate an overpressure. Due to the pressure gradient and the structural design of the drying chamber 11, no further devices are needed to convey the gaseous medium. In the present case, the overpressure in the flow duct 29 and in the intake-air ducts 30, 31, 32, 33 is 122 mm, in the collection space 34 the overpressure is approximately (−) 30 mm.

As a result of the pressure gradient of approximately 130 mm between the intake ducts and the and the return flow ducts, no air losses or cross-currents occur in the drying chamber 11.

Figure 5:
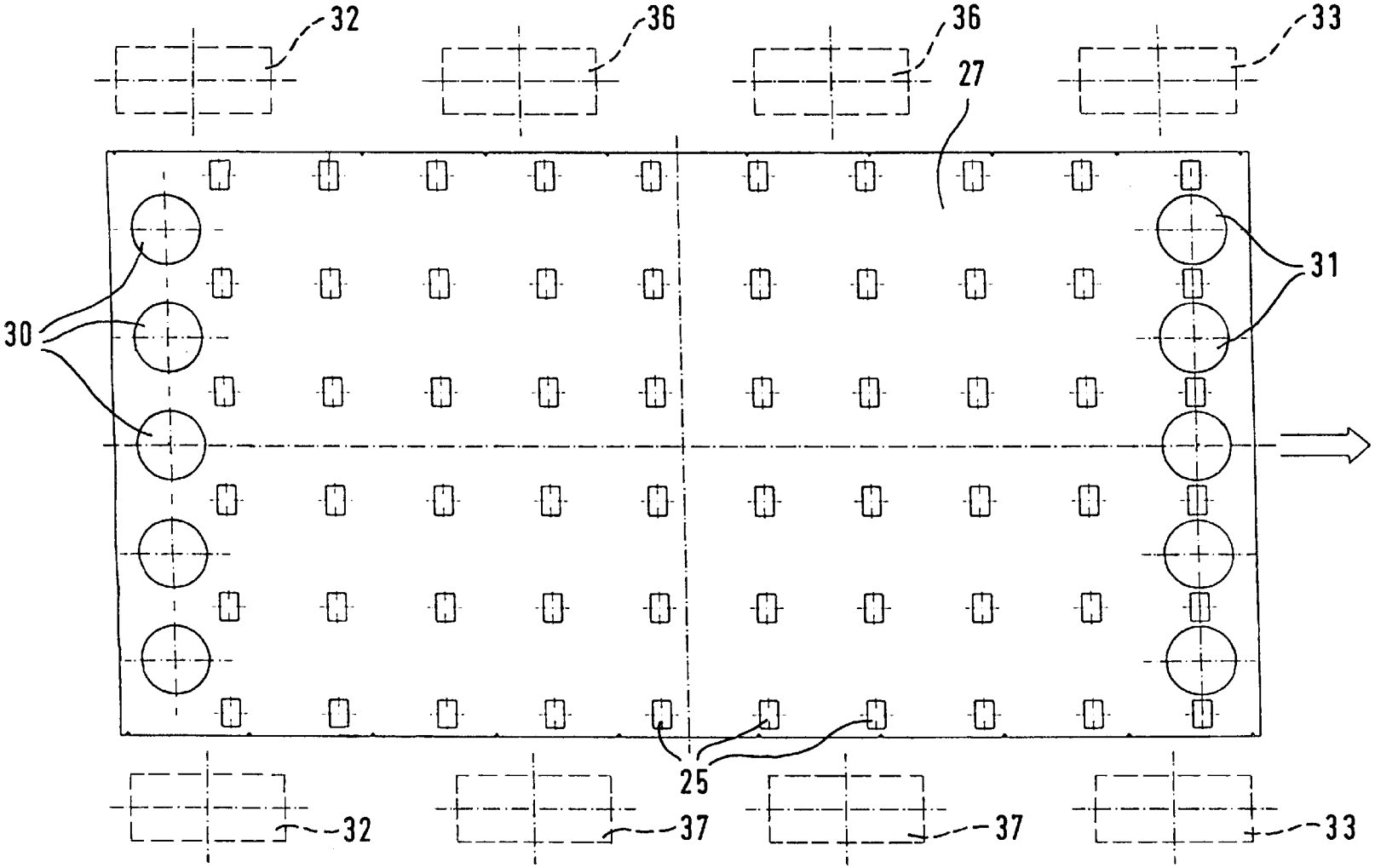
FIG. 5 shows a plan view of the (upper) nozzle box.

The intake-air ducts 30, 31, 32, 33 and the return flow shafts 36, 37 may be arranged in different ways. In the cross-section of the drying chamber as shown in embodied example according to FIG. 3, the intake-air ducts 30, 31, 32, 33 are arranged in two rows lateral to the material web 10, in each case with at least one intake-air duct 30, 32 on the right side and at least one intake-air duct 31, 33 on the left side. The upper intake-air ducts 30, 31 open into the upper nozzle box, as already described. The lower intake-air ducts 32, 33 are led either through or past the upper nozzle box and open into the lower nozzle box. In FIG. 3, at least one return-flow shaft 35 is led past the right side of the nozzle boxes and opens into the collection space 34. Return-flow shaft 37 is correspondingly led past the left side of the nozzle boxes 37, 38 and likewise opens into the collection space 34. A particularly compact design of the drying chamber 11 can be realized with the alternative embodiment as shown in FIG. 5. In this case, the intake-air ducts 30, 31 are arranged in the front and rear regions of the material web 10 relative to the conveying direction. Specifically in this example, five intake-air ducts 30, 31 are respectively distributed across the width of the nozzle box 17. These ducts are pipes having a circular cross section. Air entering via the rear intake-air ducts 30 (relative to the conveying direction) flows in the direction of movement of the material web 10, while air entering via the intake-air ducts 31 flows against the direction of material web movement. The intake-air ducts 32, 33 to the lower nozzle box 18 are arranged laterally next to the upper nozzle box 17. Arranged adjacent to each corner at the longitudinal sides of the nozzle box 18 is an intake-air duct 32 and 33, respectively, having a rectangular cross section. Accordingly, the intake air enters the nozzle chamber 18 from the sides in a direction oblique to conveying direction of the material web. The intake air of the intake-air ducts 32, 33 flows (obliquely) opposite the conveying direction of the material web. In the present example, the four return-flow shafts 36, 37 having a rectangular cross section are likewise arranged laterally next to the nozzle boxes 17 and 18. The return-flow shafts 36, 37 at the lower nozzle box 18 lie between the intake-air ducts 32, 33 arranged at the corners in a recess formed by the latter.

What is claimed is:

1. Apparatus for treating thin material webs (10) with air in a drying chamber (11), through which the material web (10) is conveyed and in which intake air is directed onto the material web (10) from above and from below by means of nozzles, the nozzles being connected to nozzle boxes (17, 18) to which air can be fed, in which (a) arranged above and below the material web (10) in each case is at least one nozzle box (17, 18) with nozzles directed onto the material web (10), (b) the return air flowing back from the material web (10) can be conveyed away by means of return-flow ducts (25, 26) which are arranged in the nozzle boxes (17, 18) and pass through the latter, characterized in that (c) the return-flow ducts (25, 26) above the upper nozzle boxes (17) open into a collection space (34) and those below the lower nozzle boxes (18) open into a return-air space (35), and (d) the return air can be conveyed away at least out of the return-air space (35), formed below the lower nozzle box (18), by at least one air conduit (36, 37) which opens into the upper collection space (34).

2. Apparatus according to claim 1, characterized in that a plurality of return-flow shafts (40, 41) laterally adjacent to the two nozzle boxes (17, 18) lead from the lower return-air space (35) into the upper collection space (34).

3. Apparatus according to claim 1, characterized in that the intake air from a region outside of the upper collection space (34) can be fed to the nozzle boxes (17, 18) by means of intake-air ducts (30, 31 and 32, 33, respectively) connected to each nozzle box (17, 18).

4. Apparatus according to claim 1, characterized in that, in the region of the upper nozzle box (17), intake-air ducts (30, 31) open into the nozzle box (17) in the region of a top box wall (27), at mutually opposite end regions of the elongate nozzle box (17).

5. Apparatus according to claim 1, characterized in that intake-air ducts (32, 33) for supplying the lower nozzle box (18) run laterally past the upper nozzle box (17) and open laterally into the lower nozzle box (18).

6. Apparatus according to claim 1, characterized in that the return air which has been combined in the upper collection space (34) can partly be conducted away out of the drying chamber (11) to the outside via a return-air shaft (39) and can partly be fed back into the treatment process.

7. Apparatus according to claim 6, characterized in that the intake-air ducts (30, 31) for the upper nozzle box (17) and/or the intake-air ducts (32, 33) for the lower nozzle box (18) are connected to the flow duct (29).

8. Apparatus according to claim 1, characterized by the following features:

(a) arranged on the side of the nozzle boxes (17, 18) facing the material web (10) are slot nozzles (19, 24) which extend transversely to the conveying direction of the material web (10) and are connected to the interior of the nozzle box (17, 18) via openings in one box wall (20, 22);

(b) return-flow ducts (25, 26) are formed in the nozzle box (17, 18) between the adjacent slot nozzles (19, 24), which are arranged spaced apart from one another, said return-flow ducts (25, 26) passing through the nozzle box (17, 18) and open on both sides of the nozzle box (17, 18) so that the return air reflected from the material web (10) can be conducted away upwards and downwards via the return-flow ducts (25, 26).

9. Apparatus according to claim 1, characterized in that the nozzles (19, 24) are slot nozzles.

10. Apparatus according to claim 2, characterized in that two return-flow shafts (36, 37) are arranged on each side of the nozzle boxes (17, 18) in the central region thereof.

11. Apparatus according to claim 6, characterized in that the return air can be fed back by being introduced into a flow duct (29) which is formed in the upper region of the drying chamber (11) and in which the return air received is mixed with fresh air fed in from outside and can be conducted via treatment units.

12. Apparatus according to claim 11, characterized in that the treatment units are equipped with air heaters (40).

* * * * *